US007419402B2

(12) United States Patent
Carnahan et al.

(10) Patent No.: US 7,419,402 B2
(45) Date of Patent: Sep. 2, 2008

(54) BACKSHELL DEVICE FOR A CONNECTOR

(75) Inventors: Paula Marie Carnahan, Quail Valley, CA (US); Paul David Zakary, Seattle, WA (US)

(73) Assignee: Deutsch Engineered Connecting Devices, Inc., Hemet, CA (US)

( * ) Notice: Subject to any disclaimer, the term of this patent is extended or adjusted under 35 U.S.C. 154(b) by 0 days.

(21) Appl. No.: 11/856,703

(22) Filed: Sep. 17, 2007

(65) Prior Publication Data

US 2008/0009173 A1 Jan. 10, 2008

Related U.S. Application Data

(63) Continuation-in-part of application No. 11/387,149, filed on Mar. 21, 2006.

(60) Provisional application No. 60/707,321, filed on Aug. 10, 2005.

(51) Int. Cl.
*H01R 13/58* (2006.01)

(52) U.S. Cl. ..... 439/470

(58) Field of Classification Search ..... 439/352, 439/609, 321, 92, 95, 108, 607, 610, 320, 439/322–323, 315–318, 446, 471, 470, 472, 439/31, 473; 385/86, 138
See application file for complete search history.

(56) References Cited

U.S. PATENT DOCUMENTS

| | | | |
|---|---|---|---|
| 2,972,492 A | 2/1961 | Mintz et al. | |
| 3,009,129 A | 11/1961 | Kirk, Jr. | |
| 3,076,655 A | 2/1963 | Washblum, Jr. | |
| 3,944,317 A | 3/1976 | Oberdiear | |
| 4,026,628 A | 5/1977 | Duffner et al. | |
| 4,280,746 A | 7/1981 | Ignatowicz | |
| 4,613,198 A | 9/1986 | Selvin et al. | |
| 4,830,628 A | 5/1989 | Dyson et al. | |
| 4,863,396 A * | 9/1989 | Johnson | 439/470 |
| 4,921,449 A | 5/1990 | Fish | |
| 4,984,995 A | 1/1991 | Tucker et al. | |

(Continued)

FOREIGN PATENT DOCUMENTS

EP 0566090 A1 10/1993

(Continued)

OTHER PUBLICATIONS

"Lightweight Interconnections" Roland B. Lawrence and Thomas Howell, 1986, American Chemical Society, pp. 1643-1647.

(Continued)

*Primary Examiner*—Edwin A. León
(74) *Attorney, Agent, or Firm*—O'Melveny & Myers LLP

(57) ABSTRACT

A backshell device and assembly are provided for achieved improved signal integrity, wherein the design of the backshell device is less complicated, more light weight, and easier to build and use than existing devices. In one embodiment, the backshell device can be coupled to adaptor which is coupled to a connector. The backshell device generally comprises a mounting section coupled to the adaptor, and an extension section extending from the mounting section. The extension section preferably comprises an increased-diameter section configured to accommodate a non-staggered or aligned arrangement of a plurality of solder sleeves of the wiring harness.

20 Claims, 19 Drawing Sheets

U.S. PATENT DOCUMENTS

| | | | | | |
|---|---|---|---|---|---|
| 5,018,987 | A | | 5/1991 | Kirma | |
| 5,061,208 | A | | 10/1991 | Bixler | |
| 5,102,351 | A | | 4/1992 | Meshel | |
| 5,178,559 | A | | 1/1993 | Mello | |
| 5,212,750 | A | | 5/1993 | Wright | |
| 5,246,379 | A | | 9/1993 | Wright | |
| 5,308,264 | A | | 5/1994 | Perretta et al. | |
| 5,342,203 | A | | 8/1994 | Perretta et al. | |
| 5,368,504 | A | | 11/1994 | Muzslay et al. | |
| 5,380,224 | A | | 1/1995 | DiCicco | |
| 5,394,502 | A | | 2/1995 | Caron | |
| 5,435,760 | A | * | 7/1995 | Miklos | 439/321 |
| 5,474,473 | A | | 12/1995 | Perretta et al. | |
| 5,521,998 | A | | 5/1996 | Walles et al. | |
| 5,580,278 | A | | 12/1996 | Fowler et al. | |
| 5,702,263 | A | * | 12/1997 | Baumann et al. | 439/321 |
| 5,713,763 | A | | 2/1998 | Schwarz | |
| 5,820,398 | A | | 10/1998 | Stabroth et al. | |
| 5,855,493 | A | | 1/1999 | Shelly | |
| 6,126,477 | A | | 10/2000 | Smith et al. | |
| 6,146,204 | A | | 11/2000 | Lazaro, Jr. | |
| 6,196,865 | B1 | | 3/2001 | Ruffel et al. | |
| 6,419,519 | B1 | | 7/2002 | Young | |
| 6,491,542 | B1 | | 12/2002 | Zerebilov | |
| 6,565,263 | B2 | | 5/2003 | Schulz et al. | |
| 6,602,085 | B2 | | 8/2003 | Young et al. | |
| 6,632,102 | B1 | | 10/2003 | Gherardini | |
| 2003/0032336 | A1 | | 2/2003 | Lazaro, Jr. et al. | |
| 2003/0148672 | A1 | | 8/2003 | Henry et al. | |

FOREIGN PATENT DOCUMENTS

| | | | |
|---|---|---|---|
| EP | 0695469 | B1 | 11/1996 |
| GB | 2368978 | A | 5/2002 |
| WO | WO93/06637 | | 4/1993 |
| WO | WO98/2822 | | 7/1998 |

OTHER PUBLICATIONS

"Quick-Disconnect Harness System for Helmet-Mounted Displays" P. T. Bapu, J. M. Aulds, S. P. Fuchs, and Dave McComick, 1992, SPIE vol. 1695 Helmet-Mounted Displays III, pp. 91-99.

* cited by examiner

BACKSHELL DEVICE FOR A CONNECTOR

CROSS-REFERENCE TO RELATED APPLICATION

This application is a continuation-in-part of U.S. patent application Ser. No. 11/387,149, entitled "Backshell Device for a Connector," filed Mar. 21, 2006, which claims priority to U.S. Provisional Patent Application Ser. No. 60/707,321, filed Aug. 10, 2005, the contents of each of which are incorporated in their entirety into this disclosure by reference.

BACKGROUND OF THE INVENTION

1. Field of the Invention

The present invention is directed towards connection systems for communicating electrical signals, and more particularly, to a backshell device for a connector.

2. Description of Related Art

Conventional backshell devices provide a rigid and secure connection of a wiring harness to an electrical connector. Due to concerns for material strength, many conventional backshell devices are formed of aluminum or steel and are, sometimes, thick and/or heavy. In aircraft and aerospace applications, it is desirable to have lightweight electrical and mechanical components. To reduce weight, some backshell devices are formed of lightweight materials, which can often be more expensive than using aluminum or steel. Typically, these conventional lightweight backshell devices are still too thick and heavy because lightweight materials may require a larger footprint to provide a sizable strength similar to steel.

Moreover, conventional backshell devices often require complete disassembly of the connector wiring if maintenance requires replacement or addition of a backshell device to a connector that was not originally installed with a backshell device. The removal of the wiring harness typically increases labor costs.

In addition, known backshell devices can be complicated, heavy, and labor-intensive to build, often comprising numerous molded parts, multiple metal inserts, and one or more split rings. Conventional backshell device designs often have an extensive length (e.g., approximately 1.7-3.7 inches), having signal wires with reduced shielding, resulting in reduced signal integrity.

Accordingly, it would be desirable to provide a backshell device that provides improved signal integrity, is less complicated and more light weight, and easier to build and use.

SUMMARY OF THE INVENTION

The present invention is directed to a backshell device for a connector, such as, for example, an electrical connector.

In one embodiment, the backshell device includes a mounting section coupled to a portion of the connector. A removable extension section extends from the mounting section and is attached to the mounting section via one or more separation features. A securing member is positioned around the mounting section for securing the mounting section to the connector.

The connector includes a housing having a receiving section that extends therefrom. The mounting section of the backshell device couples to the receiving section of the connector. The securing member is positioned around the mounting section of the backshell device and the receiving section of the connector to secure the backshell device to the connector.

In one aspect, the mounting section includes one or more anti-rotation features that protrude from an inner surface of the mounting section. In another aspect, the receiving section of the connector may include a second recessed groove adjacent to the first recessed groove that couples with the anti-rotation features of the mounting section of the backshell device to thereby inhibit rotation of the backshell device with respect to the connector.

The removable extension section is separated from the mounting section by cutting the separation features. In general, a portion of the backshell device can be removed when the removable extension section is separated from the mounting section. For example, 65% of the backshell device can be removed when the removable extension section is separated from the mounting section.

The connector includes a wiring harness that extends from the receiving section of the housing. In one aspect, the wiring harness is secured to the removable extension section of the backshell device via at least one tie wrap to thereby provide strain relief to the wiring harness. In another aspect, the wiring harness includes an overbraid that shields the wiring harness.

In general, a portion of the removable extension section extends from the mounting section at an angle between 0° and 90°. In one preferred example, a portion of the removable extension section may extend from the mounting section at an angle of approximately 45°. Alternately, in another preferred example, a portion of the removable extension section extends from the mounting section at an angle of approximately 90°. In another aspect, the removable extension section includes a selectable pivot feature that allows a portion of the removable extension section to pivot at an angle between 0° and 90°.

In another embodiment, a backshell assembly includes a connector and a backshell device having a mounting section that couples to a portion of the connector. The backshell device includes a removable extension section that extends from the mounting section and is attached to the mounting section via separation features. A securing member is positioned around the mounting section for securing the mounting section to the connector.

The present invention satisfies the need for improved signal integrity by providing a backshell device that accommodates a non-staggered or aligned arrangement of solder sleeves of the wiring harness, and thereby makes it possible to implement signal wires extending from the solder sleeves to the connector having a uniform predetermined length, preferably a uniform reduced or minimized length.

In accordance with one aspect of the embodiments described herein, there is provided a backshell device for a connector coupled to an adaptor. In one embodiment, the backshell device comprises a mounting section coupled to the adaptor and configured to at least partially cover a wiring harness. The backshell device further comprises an extension section that extends from the mounting section and is configured to at least partially cover the wiring harness. The extension section preferably comprises an increased-diameter section configured to accommodate a non-staggered arrangement of a plurality of solder sleeves of the wiring harness. The increased-diameter section allows signal wires extending from the solder sleeves to the connector to have a uniform predetermined length, preferably a uniform reduced or minimized length. The mounting section is typically configured to receive a securing member that wraps around the mounting section. In another embodiment, the backshell device connects directly to the connector without the adaptor.

In accordance with another aspect of the embodiments described herein, there is provided a backshell assembly comprising a connector, an adaptor coupled to the connector, and a backshell device. The backshell device preferably comprises a mounting section coupled to the adaptor, and an extension section that extends from the mounting section and comprises an increased-diameter section configured to accommodate an aligned arrangement of a plurality of solder sleeves of a wiring harness. The assembly further can further comprise a securing member positioned around the mounting section of the backshell device.

A more complete understanding of the invention will be afforded to those skilled in the art, as well as a realization of additional advantages and objects thereof, by a consideration of the following detailed description of the preferred embodiment. Reference will be made to the appended sheets of drawings that will first be described briefly.

DETAILED DESCRIPTION OF THE PREFERRED EMBODIMENT

Reference will now be made to the drawings wherein like numerals refer to like parts throughout.

Figure 1A:
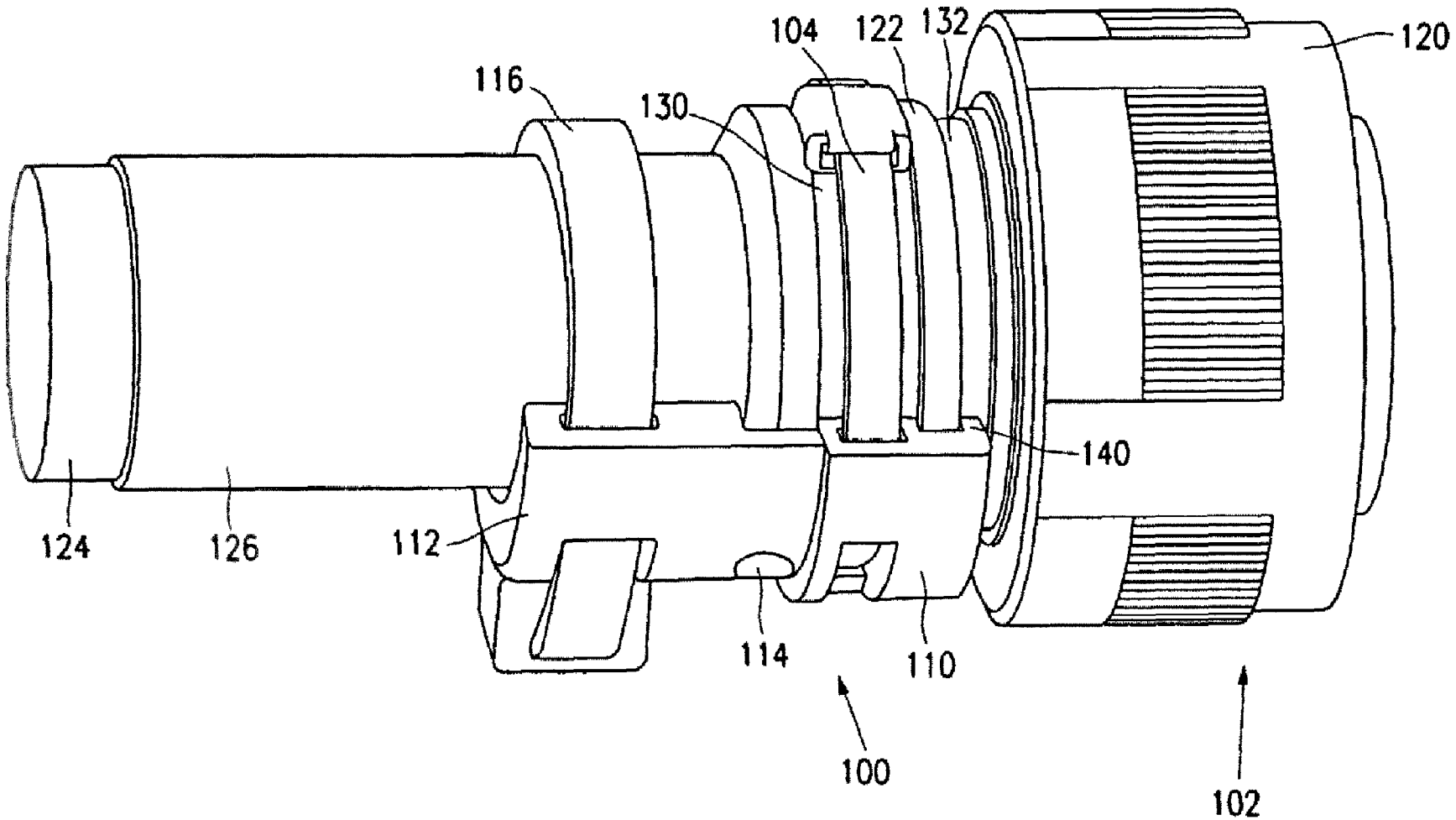
FIG. 1A is a perspective view of a backshell device coupled to a connector.

FIG. 1A is a perspective view of a backshell device 100 coupled to a connector 102 via a securing member 104. Connector 102 includes a wiring harness 124 and an overbraid or shielding sock 126 that overlies wiring harness 124.

Backshell device 100 includes a mounting section 110 and a removable extension section 112. Removable extension section 112 extends from mounting section 110 and attaches thereto via separation features 114. In one embodiment, mounting section 110 and removable extension section 112 are semi-cylindrical. In another embodiment, mounting section 110 and removable extension section 112 comprise a lightweight material including a composite material, a metallic material, a metallic composite material, or various lightweight combinations thereof.

Connector 102 includes a housing 120 having a receiving section 122 extending therefrom. In one embodiment, housing 120 and receiving section 122 of connector 102 are cylindrical, and are adapted to receive the semi-cylindrical shape of mounting section 110 and removable extension section 112 of backshell device 100. It should be appreciated by those skilled in the art that connector 102 may comprise a male type of connector, a female type of connector, a plug type of connector, or a receptacle type of connector. Moreover, connector 102 may comprise an electrical connector or various other generally known type of connectors without departing from the scope of the present invention.

As shown in FIG. 1A, mounting section 110 of backshell device 100 overlies and couples to receiving section 122 of connector 102, and securing member 104 is positioned around mounting section 110 and secures mounting section 110 of backshell device 100 to receiving section 122 of connector 102. In one embodiment, securing member 104 comprises a band or band clamping device formed of various types of high strength materials, such as composite materials and various types of metal, such as, for example, stainless steel, aluminum, magnesium, and titanium. The securing member 104 is typically made of stainless steel.

As shown in FIG. 1A, receiving section 122 of connector 102 includes a first recessed groove 130 that receives securing member 104 of backshell device 100. In one embodiment, first recessed groove 130 includes a knurled surface. In general, the knurled surface of first recessed groove 130 may comprise various geometrical patterns and shapes, including diamond, rectangular, triangular, etc., without departing from the scope of the present invention. Moreover, receiving section 122 of connector 102 includes a second recessed groove 132 adjacent to first recessed groove 130 that receives lip feature 140 of mounting section 110 of backshell device 100 to secure backshell device 100 to connector 102 and inhibit slippage of backshell device 100 from connector 102.

In one aspect, as shown in FIG. 1A, securing member 104 clamps overbraid or shielding sock 126 and/or wiring harness 124 directly to mounting section 110 of backshell device 100 and receiving section 122 of connector 102 with 3600 uniform pressure. It should be appreciated by those skilled in the art that, wherever lightening strike or EMI are concerned, this securing technique of securing member 104 provides an improvement in shielding.

Figure 1B:
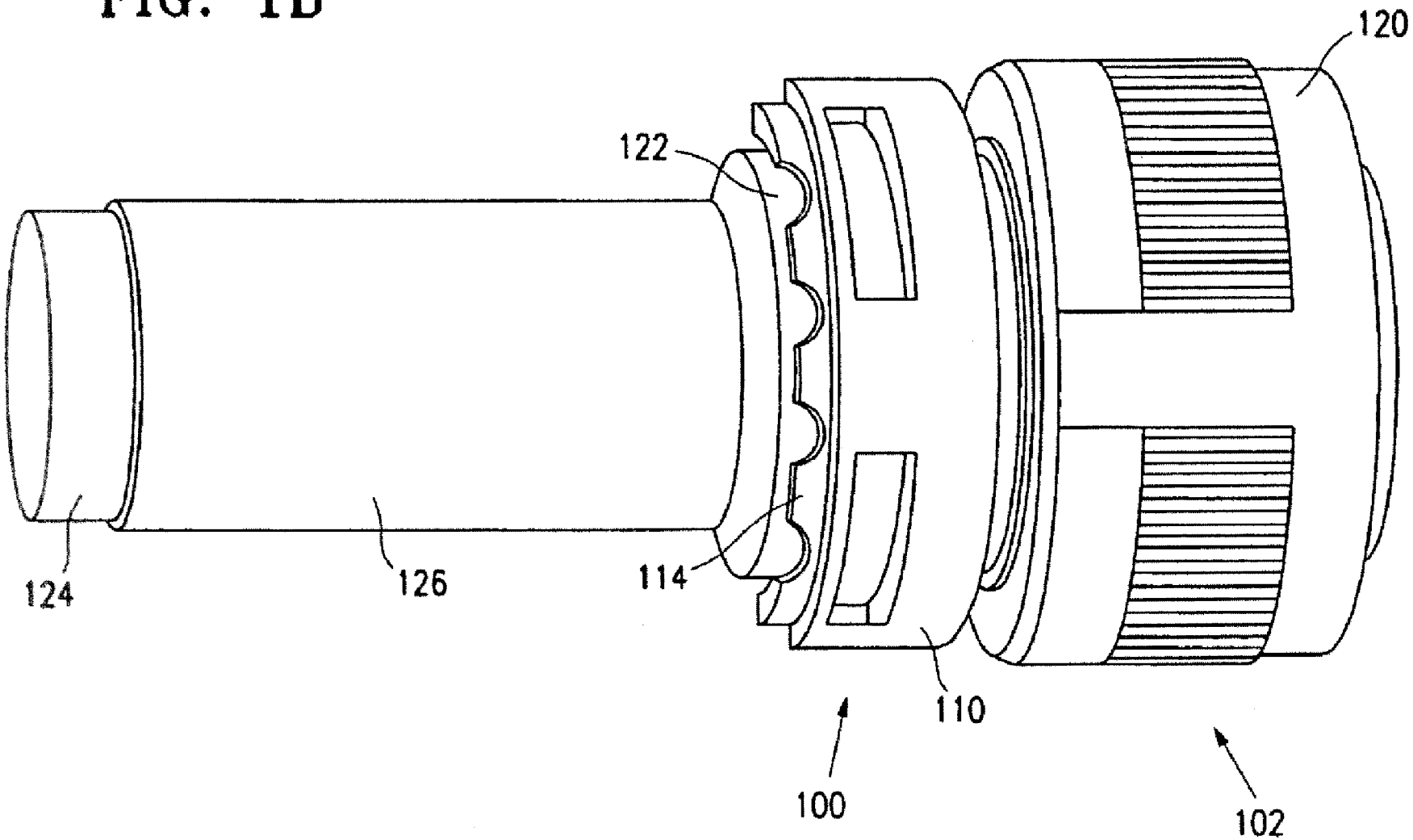
FIG. 1B is a perspective view of a backshell device coupled to connector with a portion removed.

As shown in FIG. 1B, removable extension section 112 of backshell device 100 can be separated from mounting section 110 of backshell device 100 by cutting separation features 114. In one embodiment, a portion of backshell device 100 can be removed when removable extension section 112 is separated from mounting section 110. For example, approximately 65% of backshell device 100 can be removed when removable extension section 112 is separated from mounting section 110. In general, the weight of backshell device 100 can be reduced when removable extension section 112 is separated from mounting section 110, which can provide significant weight savings. Without departing from the scope of the present invention, it should be appreciated by those skilled in the art that the backshell devices can be manufactured with removable extension sections 112 of various lengths to accommodate various types and sizes of wiring harnesses 124 with or without the inclusion of overbraid 126.

Referring to FIGS. 1A and 1B, connector 100 includes wiring harness 124 that extends from receiving section 122 of housing 120. In one embodiment, wiring harness 124 can be secured to removable extension section 112 of backshell device 100 via at least one tie wrap 116, such as a plastic tie wrap including high temperature tie wraps, to provide strain relief to wiring harness 124. In addition, wiring harness 124 may include overbraid or shielding sock 126 that shields wiring harness 124 from external interference, such as high frequency communication signals and white noise. In general, wiring harness 124 comprises one or more wires, such as a group of wires. It should be appreciated by those skilled in the art that overbraid 126 is optional, and backshell device 100 can be mounted to connector 102 with or without overbraid 126.

Figure 2:
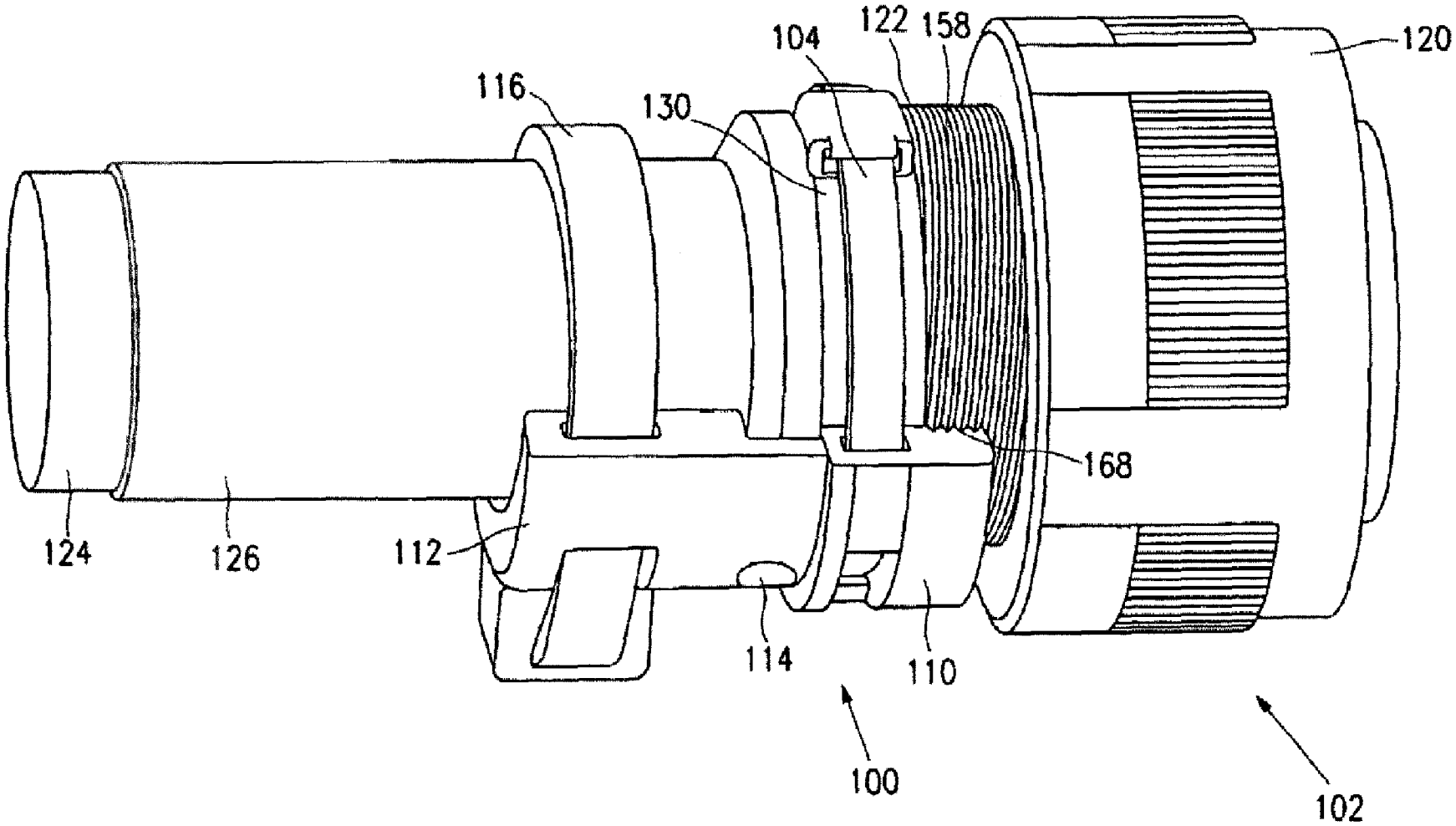
FIG. 2 is a perspective view of a backshell device coupled to connector 102 via securing member and a threaded interconnection.

FIG. 2 is a perspective view of backshell device 100 coupled to connector 102 via securing member 104 and a threaded interconnection 158, 168. As with FIG. 1A, connector 102 includes wiring harness 124 and overbraid 126 that overlies wiring harness 124. In one embodiment, as shown in FIG. 2, receiving section 122 of connector 102 includes a threaded outer surface 158 adjacent to first recessed groove 130 that interconnects to a threaded inner surface 168 of mounting section 110 of backshell device 100. This threaded interconnection between threaded outer surface 158 of connector 102 and threaded inner surface 168 of mounting section 110 secures backshell device 100 to connector 102 and inhibits slippage of backshell device 100 from connector 102.

In general applications, backshell device 100 secures and stabilizes wiring harness 124 to connector 102 by preventing movement of wiring harness 124 with respect to connector 102. In addition, mounting section 110 of backshell device 100 secures overbraid 126 to receiving section 122 of connector 102 with or without removable extension section 112. Moreover, in one aspect, securing member 104 provide 3600 of pressure to the junction between mounting section 110 of backshell device 100 and receiving section 122 of connector 102.

In some applications, backshell device 100 can be installed and coupled to connector 102 after connector 102 is already installed. As shown in FIGS. 1A and 1B, since mounting section 110 and removable extension section 112 of backshell device 100 are semi-cylindrical, backshell device 100 can be coupled to receiving section 122 of connector 102 after connector 102 is already in an installed configuration, which can provide installation labor savings. Moreover, the semi-cylindrical shape provides a reduced size and footprint, which can reduce manufacturing costs.

Figure 3:
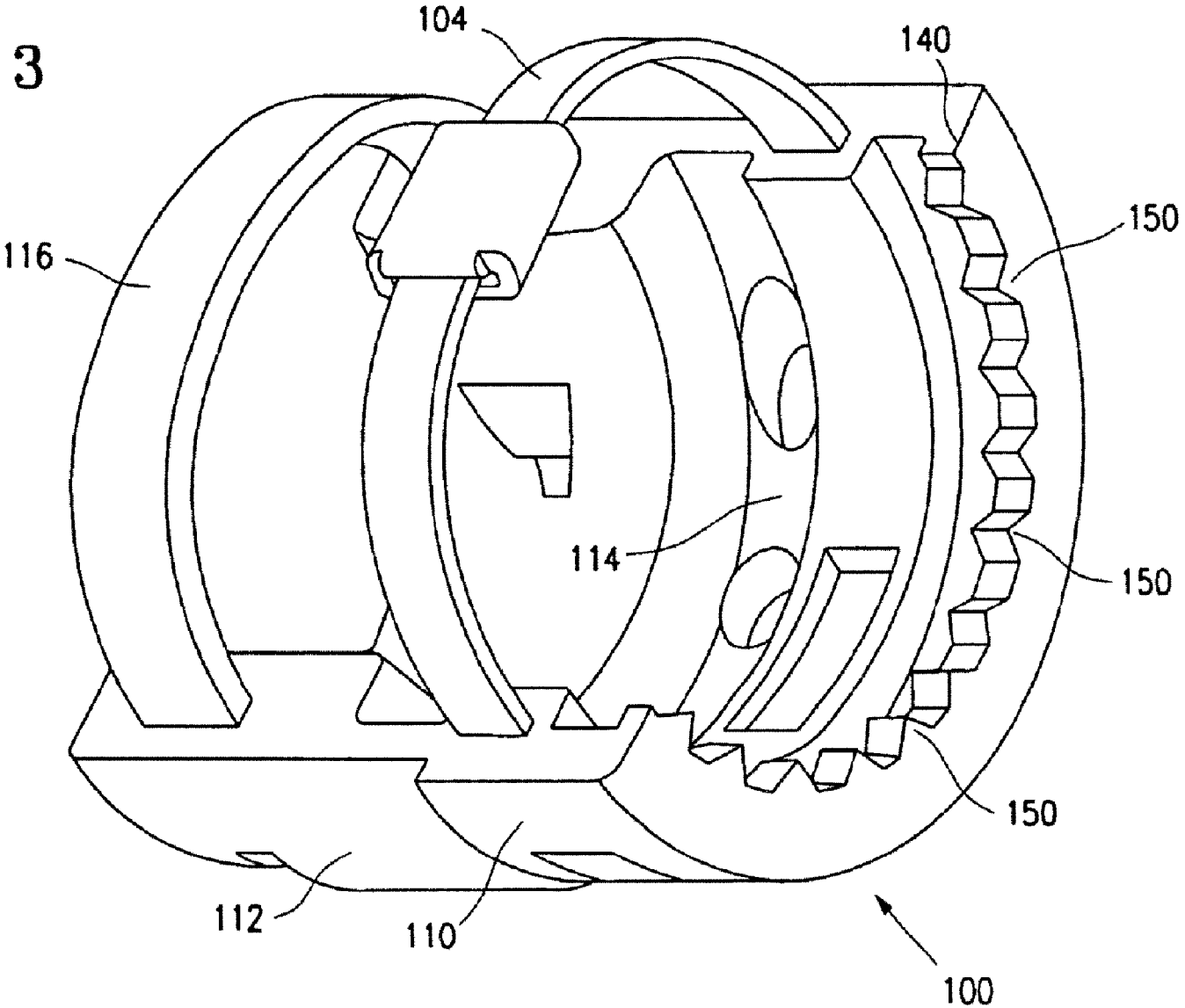
FIG. 3 is a perspective view of a backshell device having a plurality of first anti-rotation features.

FIG. 3 is a perspective view of backshell device 100 having a plurality of first anti-rotation features 150 that protrude from an inner surface of lip feature 140 of mounting section 110. In one embodiment, first anti-rotation features 150 comprise protruding triangular teeth that are equally spaced apart along an inner arced surface of lip feature 140 of mounting section 100.

Figure 4:
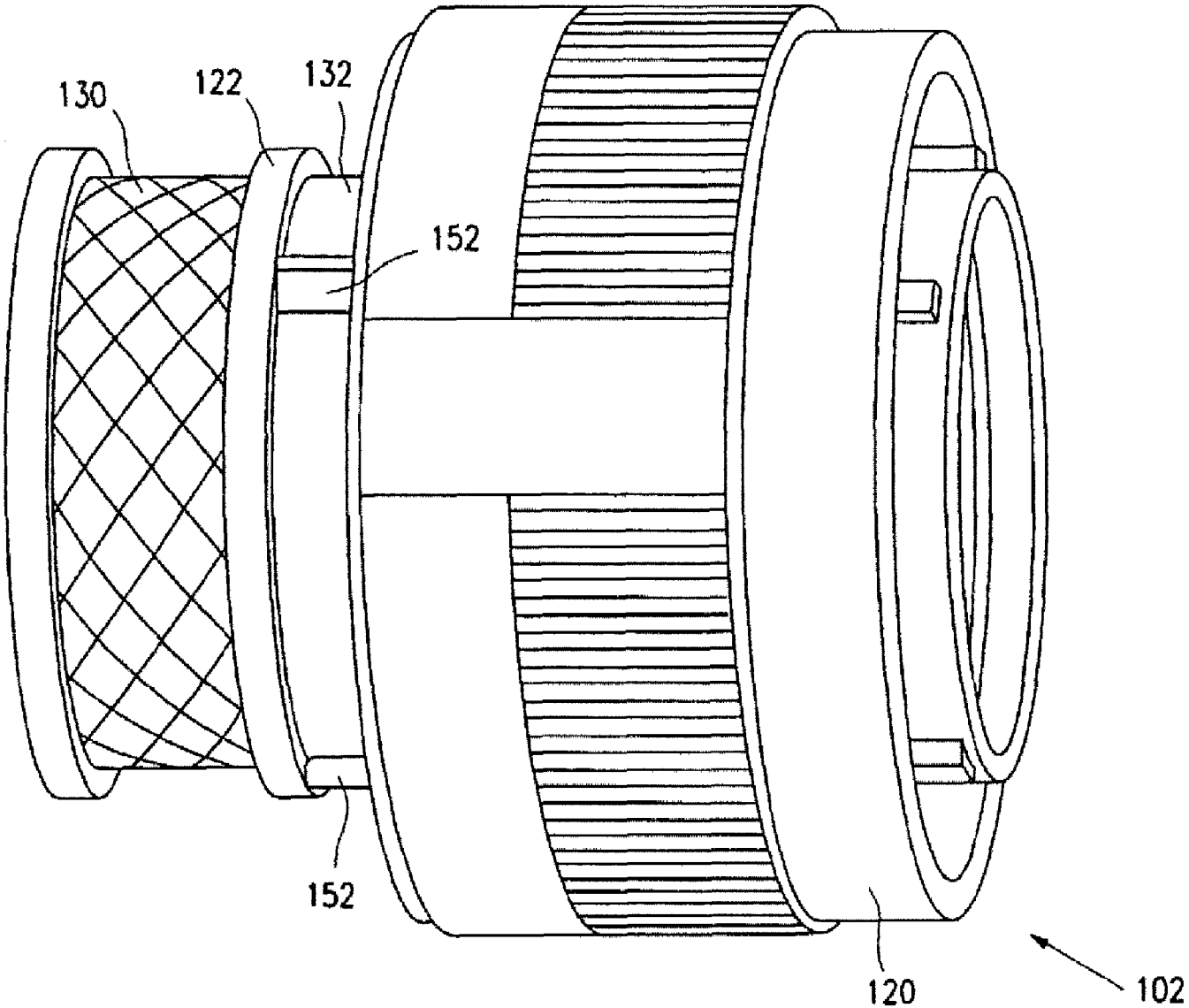
FIG. 4 is a perspective view of connector having a plurality of second anti-rotation features.

FIG. 4 is a perspective view of connector 102 having a plurality of second anti-rotation features 152 that protrude from a surface of second recessed groove 132 of receiving section 122. In one embodiment, second anti-rotation features 152 comprise protruding geometrical teeth that are equally spaced apart along the arced surface of second recessed groove 132 of receiving section 122. Second anti-rotation features 152 can comprise three protruding geometrical teeth that are equally spaced apart, at approximately 120°, around the circular surface of second recessed groove 132 of receiving section 122. The connector 102 preferably comprises three or more geometrical teeth.

In one aspect of the present invention, second anti-rotation features 152 of connector 102 are shaped to receive and interconnect with first anti-rotation features 150 of backshell device 100. Moreover, first anti-rotation features 150 of mounting section 110 of backshell device 100 interconnect with second anti-rotation features 152 of second recessed groove 132 of connector 102 to secure position and inhibit rotation of backshell device 100 with respect to connector 102.

Figure 5A:
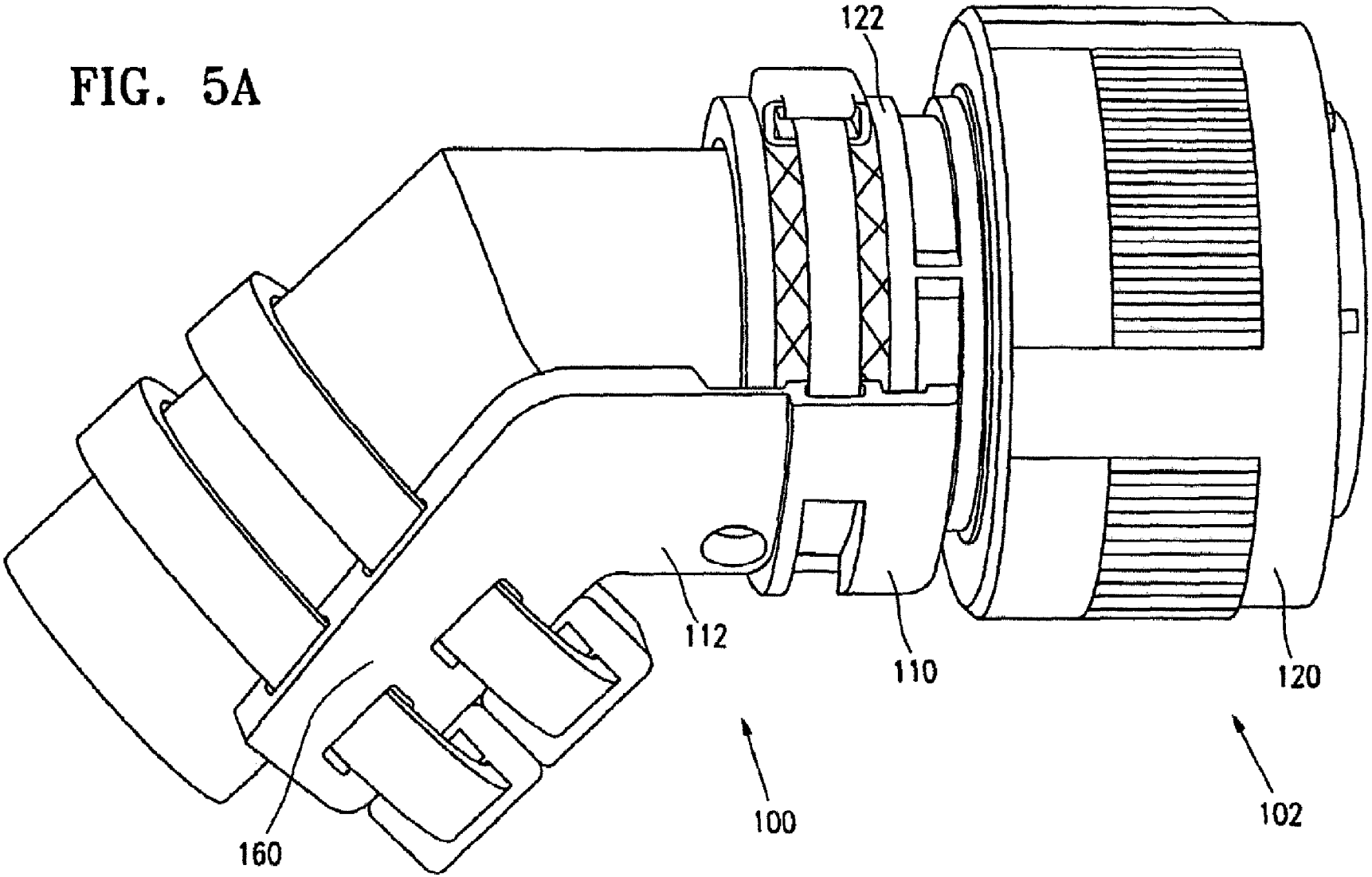
FIGS. 5A and 5B are perspective views of backshell device having an angled removable extension section.
Figure 5B:
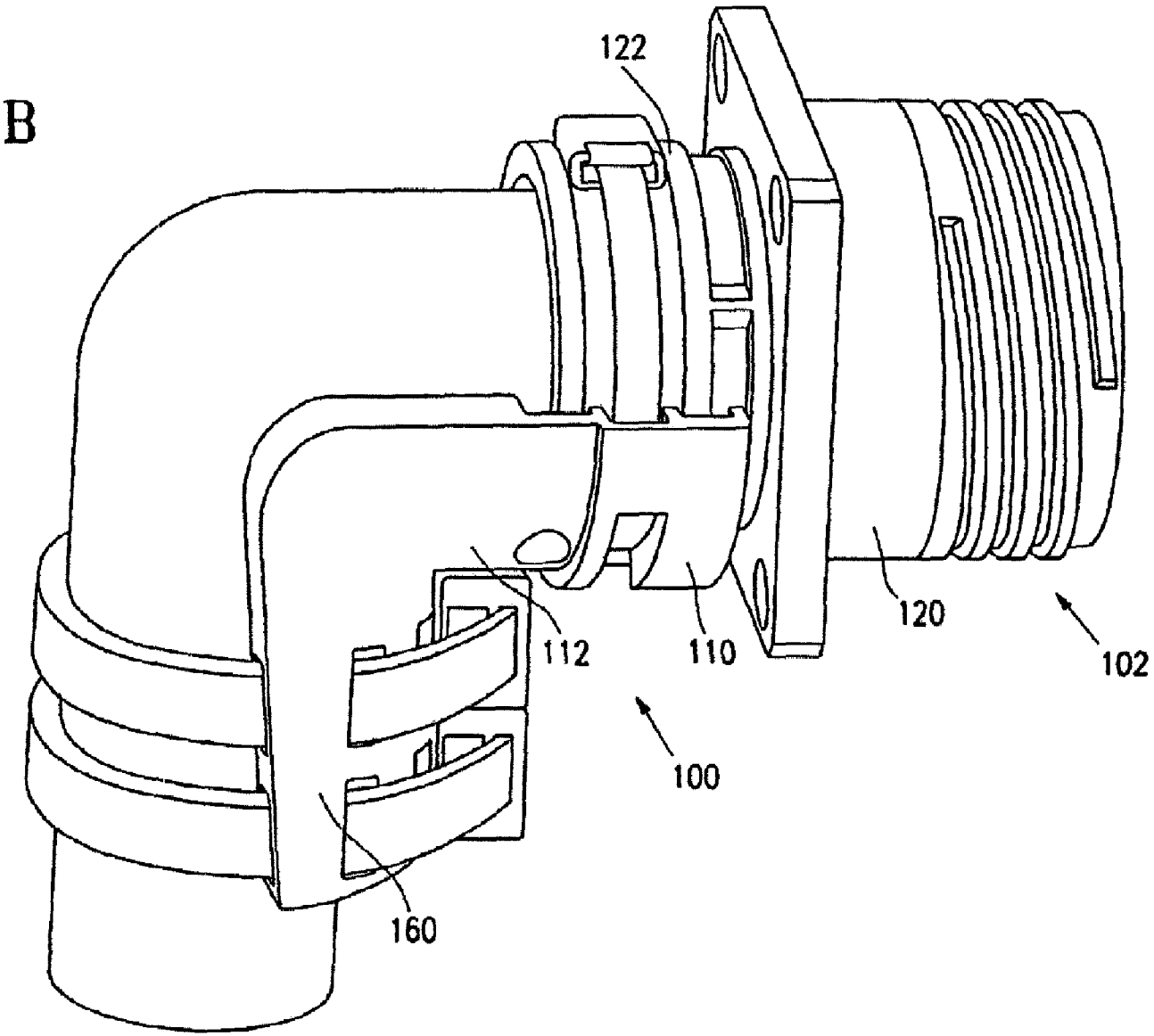

Referring to FIG. 1A, removable extension section 110 of backshell device 100 directly extends in a straight manner from mounting section 112. In one aspect, this straight extension of section 110 may be considered to extend at an angle, for example, of 0°. Alternately, FIGS. 5A and 5B are perspective views of backshell device 100 having an angled removable extension section 112. In one example, as shown in FIG. 5A, a portion 160 of removable extension section 112 may extend from mounting section 110 in an angular manner at an angle of 45°. In another example, as shown in FIG. 5B, portion 160 of removable extension section 112 may extend from mounting section 110 in an angular manner at an angle of 90°.

In general, it should be appreciated by those skilled in the art that portion 160 of removable extension section 112 may extend from mounting section 110 of backshell device 100 at any angle between 0° and 90° or 0° and 180° without departing from the scope of the present invention. Moreover, it should be appreciated by those skilled in the art that connector 102 may comprise a female type connector, as shown in FIG. 5A, or a male type connector, as shown in FIG. 5B, without departing from the scope of the present invention.

Figure 6:
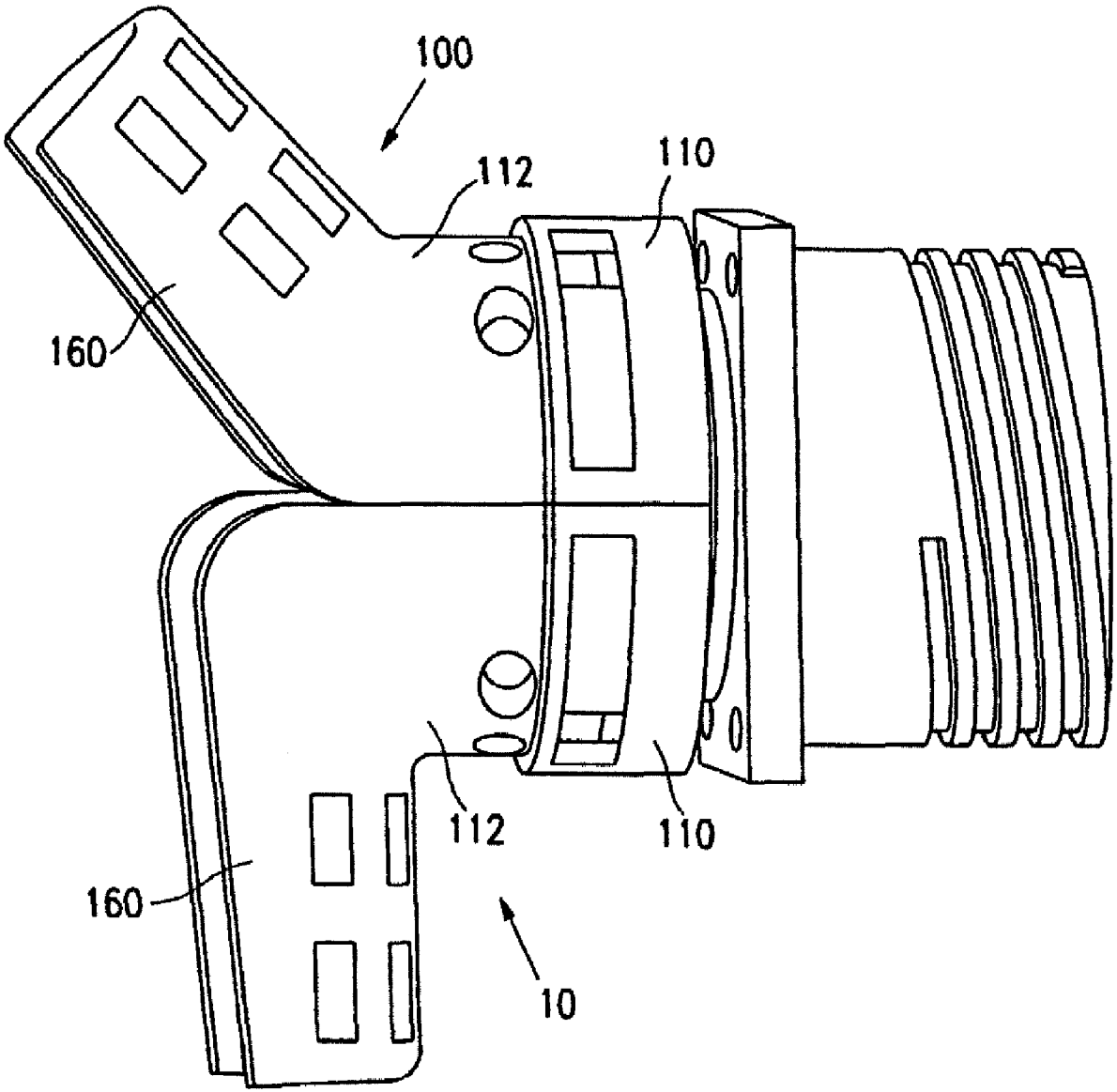
FIG. 6 is a perspective view of a backshell device having multi-exit features.

FIG. 6 is a perspective view of backshell device 100 having multi-exit features and capabilities for a plurality of wiring harnesses 124. In one embodiment, as shown in FIG. 6, secured cables can exit from a plurality of backshell devices 100 in a plurality of directions, including, for example, a 45° direction and a 90° direction. It should be appreciated by those skilled in the art that various other multi-directional configurations of the plurality of backshell devices 100 may also include 90°/90°, 45°/45°, straight/90° and straight/45° by using at least two backshell devices 100 and splitting at least two exiting wiring harnesses 124 in at least two different directions. This unique feature of the present invention facilitates connector to connector cabling or "daisy chaining" especially in a 90°/90° "T" type of configuration.

Figure 7A:
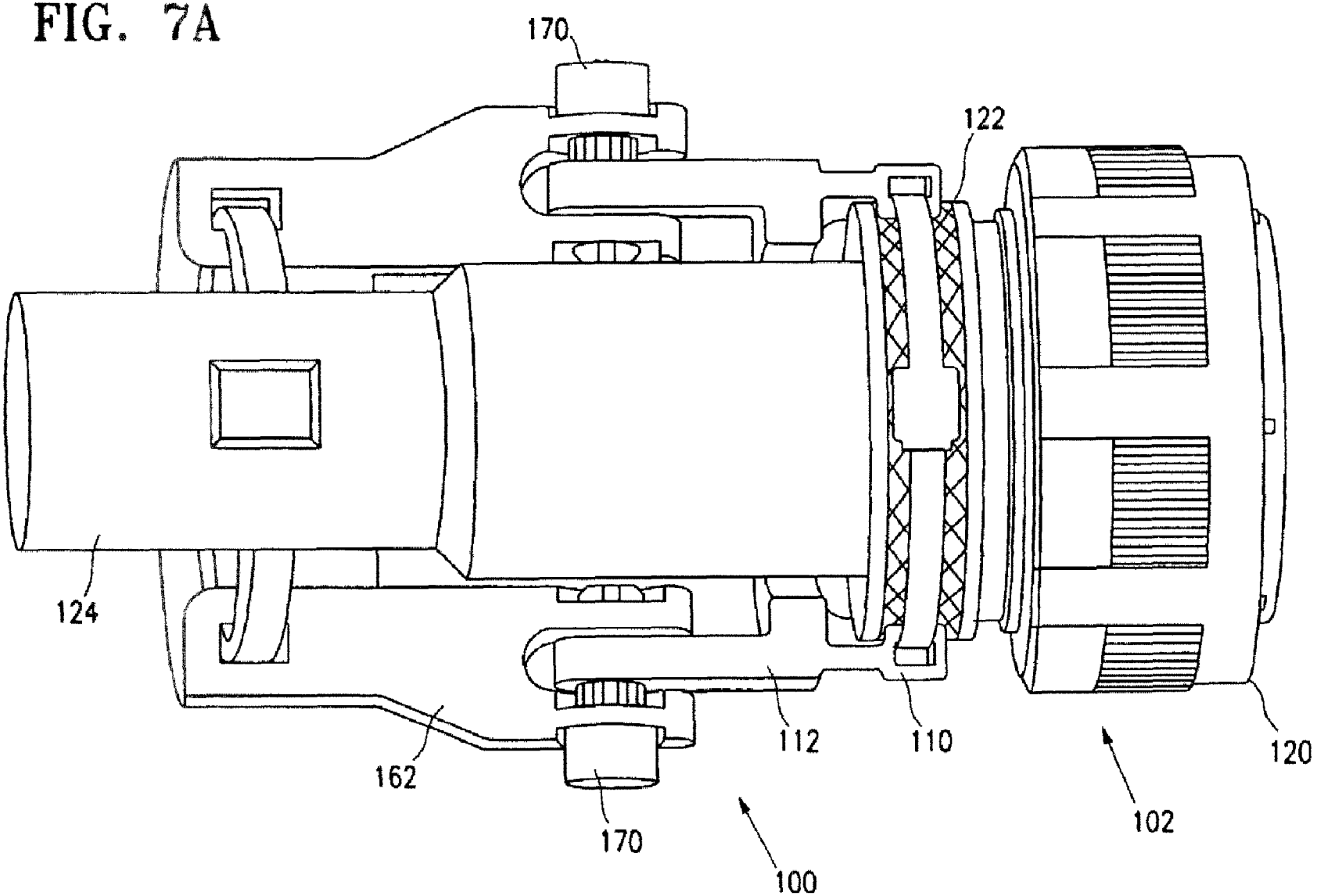
FIGS. 7A-7C are perspective views of a backshell device having removable extension section with a pivotable portion.
Figure 7B:
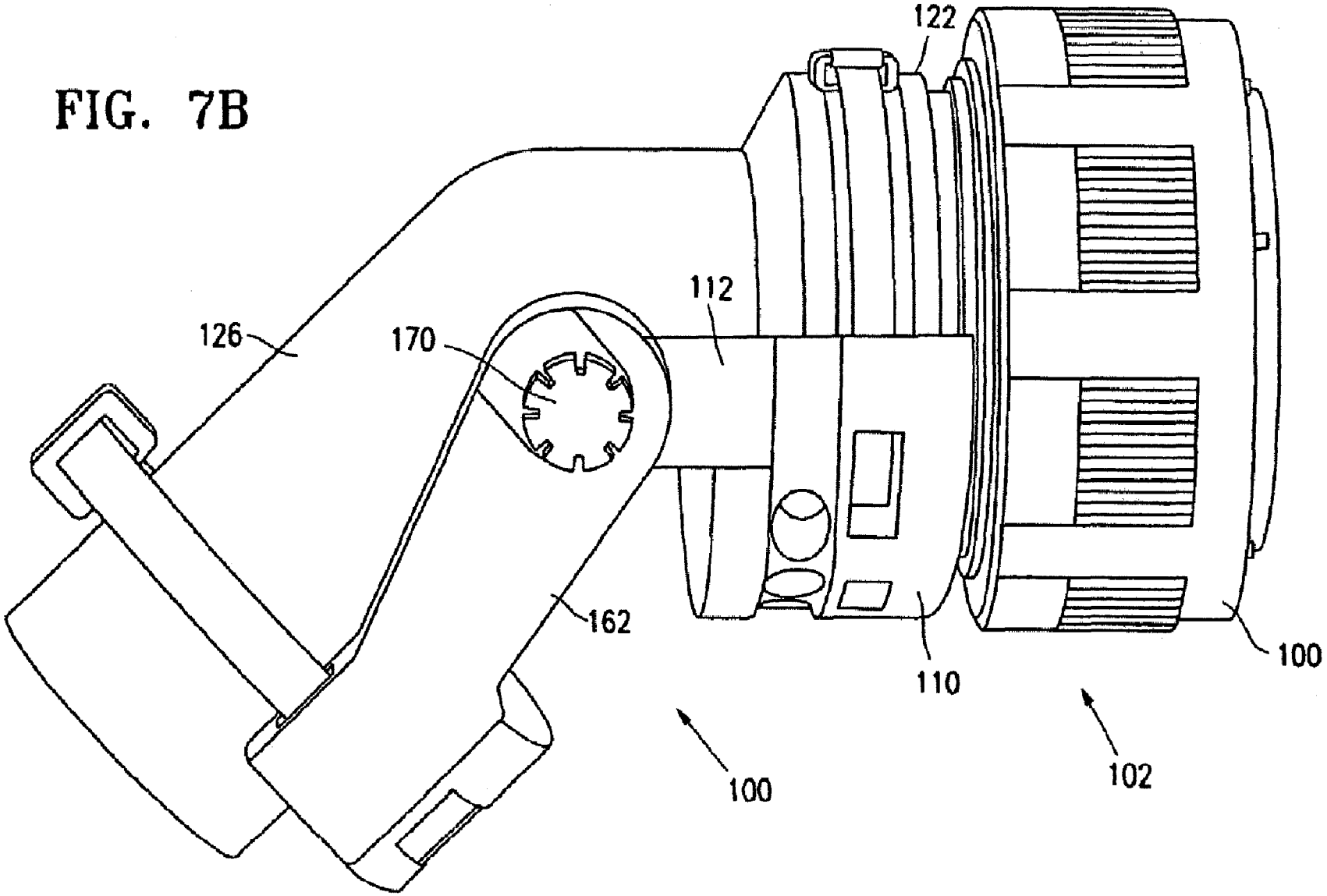
Figure 7C:
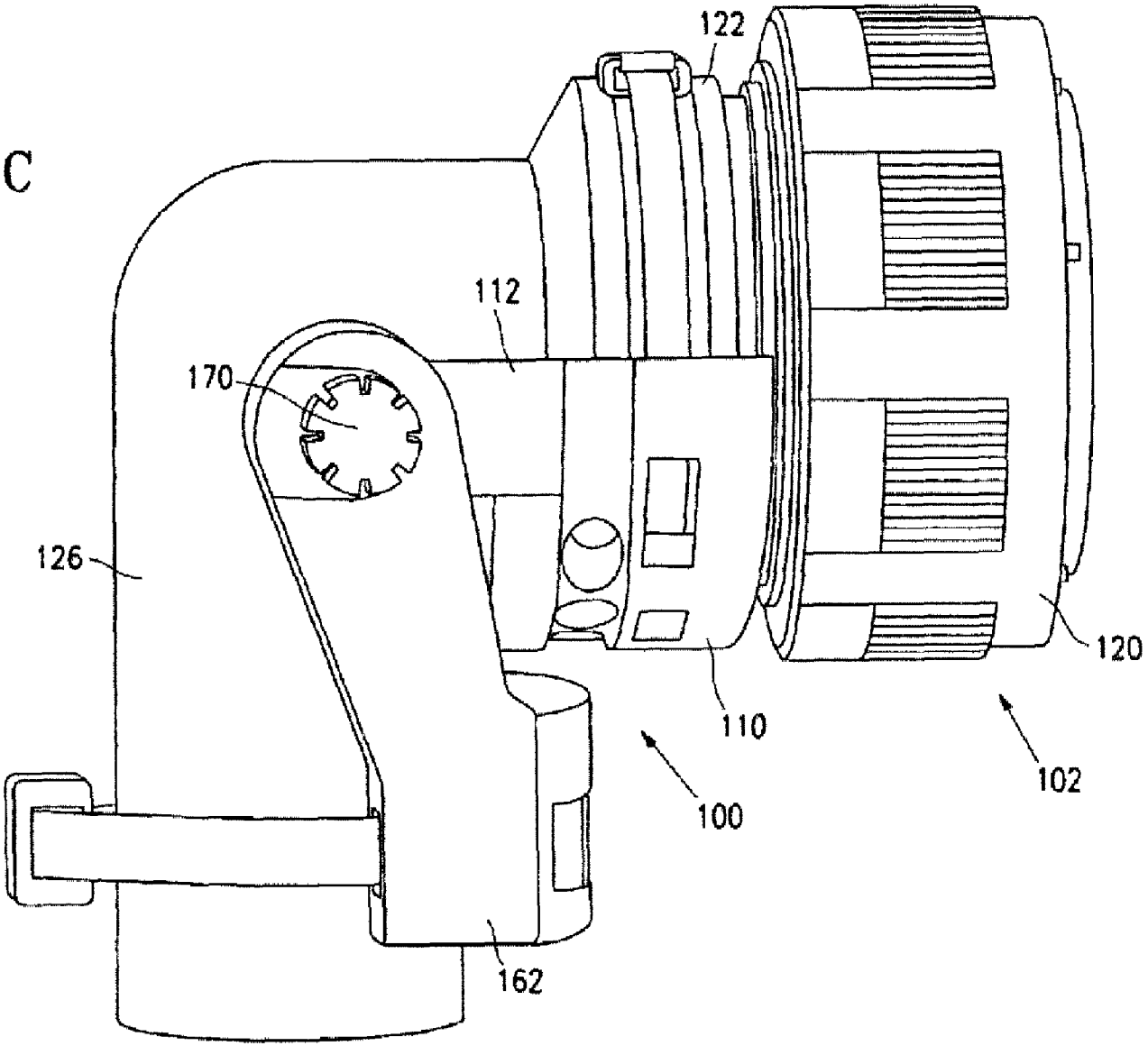

FIGS. 7A-7C are perspective views of backshell device 100 having removable extension section 112 with a pivotable portion 162. As shown in FIG. 7A, removable extension section 112 may include one or more selectable pivot features 170 that allows pivotable portion 162 of removable extension section 112 to pivot at an angle between 0° and 90° or 0° and 180° to accommodate various types of wiring harnesses 124 with or without overbraid 126.

As shown in FIG. 7A, pivotable portion 162 of removable extension section 110 can be positioned to directly extend in a straight manner from mounting section 112 at an angle, for example, of 0°. Alternately, as shown in FIG. 7B, pivotable portion 162 of removable extension section 112 may extend from mounting section 110 in an angular manner at an angle, for example, of about 45°. Additionally, as shown in FIG. 7C, pivotable portion 162 of removable extension section 112 may extend from mounting section 110 in an angular manner at an angle, for example, of about 90°. In general, it should be appreciated by those skilled in the art that pivotable portion 162 of removable extension section 112 may extend from mounting section 110 of backshell device 100 at any angle between 0° and 90° or 0° and 180° without departing from the scope of the present invention.

Figure 8:
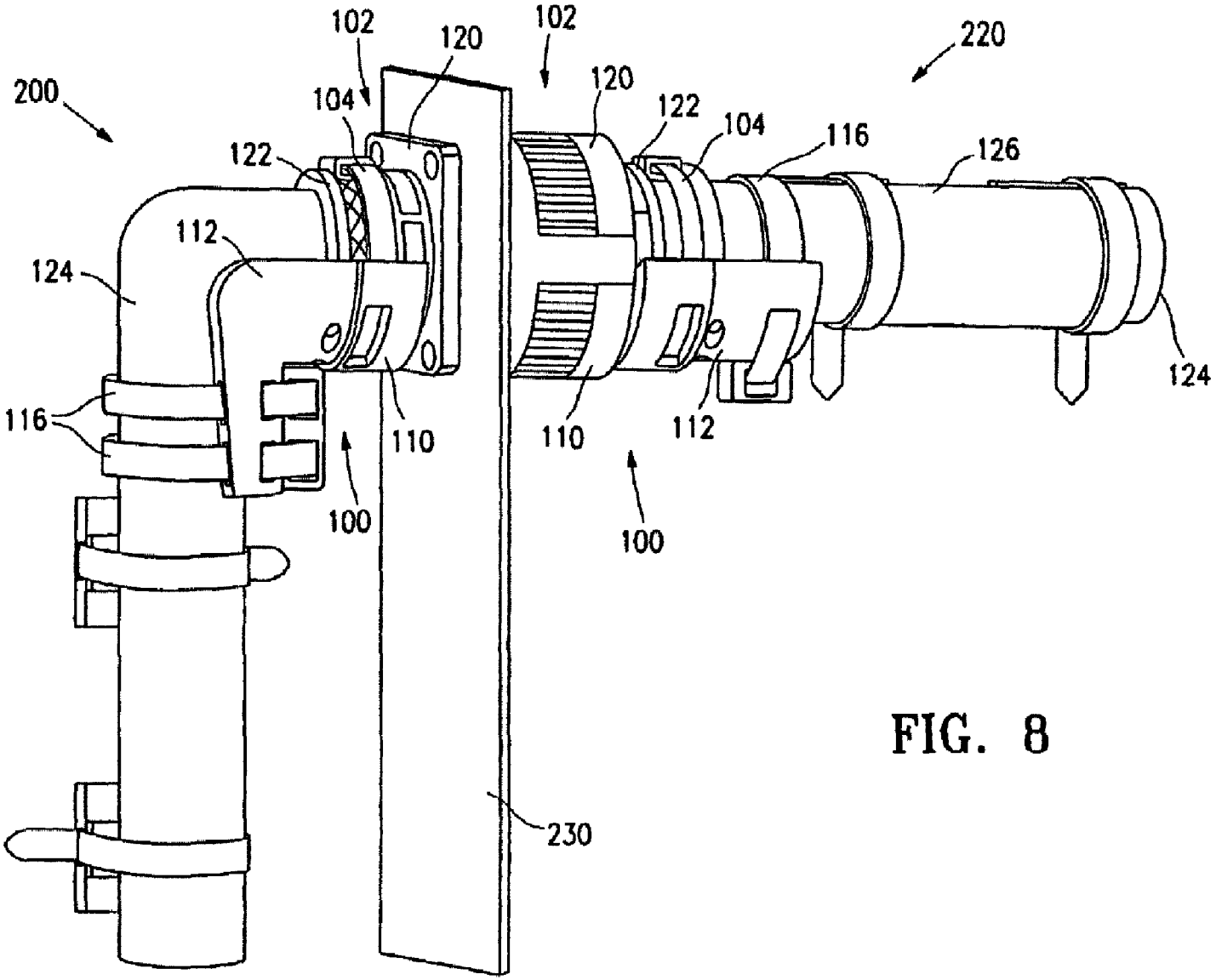
FIG. 8 is a perspective view of one example of an application of a backshell device and connector of the present invention.

FIG. 8 is a perspective view of one example of an application of backshell device 100 and connector 102 of the present invention. As shown in FIG. 8, a first backshell assembly 200 includes backshell device 100 with a 90° angled removable extension section 112, and a second backshell assembly 220 includes backshell device 100 with a straight (0° angled) removable extension section 112. In addition, first backshell assembly 200 includes a connector 102 having a male type connector, and second backshell assembly 220 includes connector 102 having a female type connector. As shown in FIG. 8, male type connector 102 of first backshell assembly 200 is interconnected to female type connector 102 of second backshell assembly 220 through a wall or partition wall 230.

In general, backshell device 100 secures and stabilizes wiring harness 124 to connector 102 with full-functional performance by preventing movement of wiring harness 124 with respect to connector 102. In addition, mounting section 110 of backshell device 100 secures overbraid 126 to receiving section 122 of connector 102 with or without removable extension section 112. Moreover, mounting section 110 and removable extension section 112 are semi-cylindrical. This allows backshell device 100 to be installed after connector 102 is installed, which can provide installation labor savings. In addition, the semi-cylindrical shape provides a reduced size and footprint, which can reduce manufacturing costs.

Figure 9:
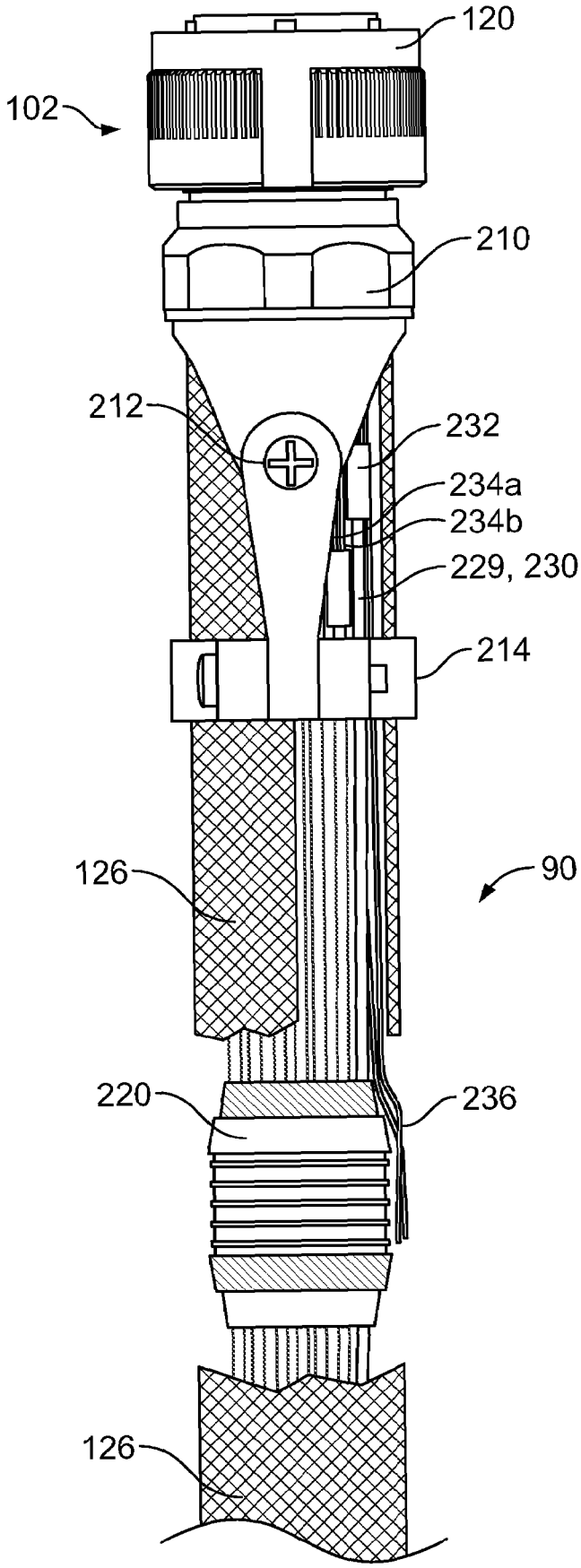
FIG. 9 (Prior Art)
FIG. 9 is a partial cross-section side view of a swing-arm backshell device.

FIG. 9 illustrates a backshell assembly 90 with a swing-arm design. The assembly 90 comprises a backshell device 214 with pivot point 212. The backshell assembly 90 comprises a coupling nut 210 for coupling with a connector 102. The connector 102 includes a housing 120 for receiving the coupling nut 210 of the assembly 90. The wiring harness 229 within the overbraid or braidsock 126 comprises one or more wires 230. Each wire 230 typically comprises at least one signal wire 234 and at least one pigtail 236. The signal wires 234 and pigtails 236 are generally insulated and shielded below the solder sleeve 232, but unshielded above the sleeve 232. The signal wires 234*a*, 234*b* are connected to the connector 102. The pigtails 236 are looped back toward and secured to the split ring 220.

It is noted that the solder sleeves 232 have a diameter that is greater than the wires 230, thereby increasing the diameter of the wiring harness 229 in certain sections. In order to fit each of the wires 230 and sleeves 232 within the limited diameter of the overbraid 126 and the backshell device 214, the sleeves 232 are placed into a staggered arrangement. The staggered arrangement of the sleeves 232 located above the split ring 220 results in a larger portion of the signal wires 234*a*, 234*b* that are exposed or unshielded, thereby reducing the integrity of the transmitted signal. Also, the unshielded signal wires 234*a*, 234*b* are more subject to flexing and breakage than wires that are shielded.

The design in FIG. 9 can be complicated, costly, and heavy. Such a design typically includes numerous molded parts, multiple aluminum rings, multiple metal inserts, eight or more pieces of stainless steel hardware pieces, and a braidsock that is at least 10-12 inches in length at approximately 0.007 lbs/inch in weight. In addition, the shield termination typically includes one or more molded split rings 220, one or more band clamping devices, and multiple tie wraps.

The extensive length (typically around 1.7-3.7 inches) of the unshielded signal wires 234*a*, 234*b* without their individual shields compromises signal integrity. Multiple length shield termination, with staggered solder sleeves 232 makes the assembly of such a backshell design labor intensive, requiring difficult pigtail 236 terminations, the split ring 220, and multiple taping operations. The relatively long braid sock 126 (typically around 7-11 inches at around 0.007 lbs/inch), multiple stainless steel hardware components, and multi-piece shield termination results in a relatively heavy backshell design. Ideally, functions of the backshell assembly 90 would include protecting vulnerable wires 234*a*, 234*b* as they exit the connector, as well as directing the cables 230 in the appropriate direction. The conventional swing arm backshell design shown in FIG. 9 necessitates a split ring 210, so that shield communing is performed outside the backshell, which results in unprotected pigtail wires. In addition, the signal wires are subject to flexing and breakage.

Figure 10:
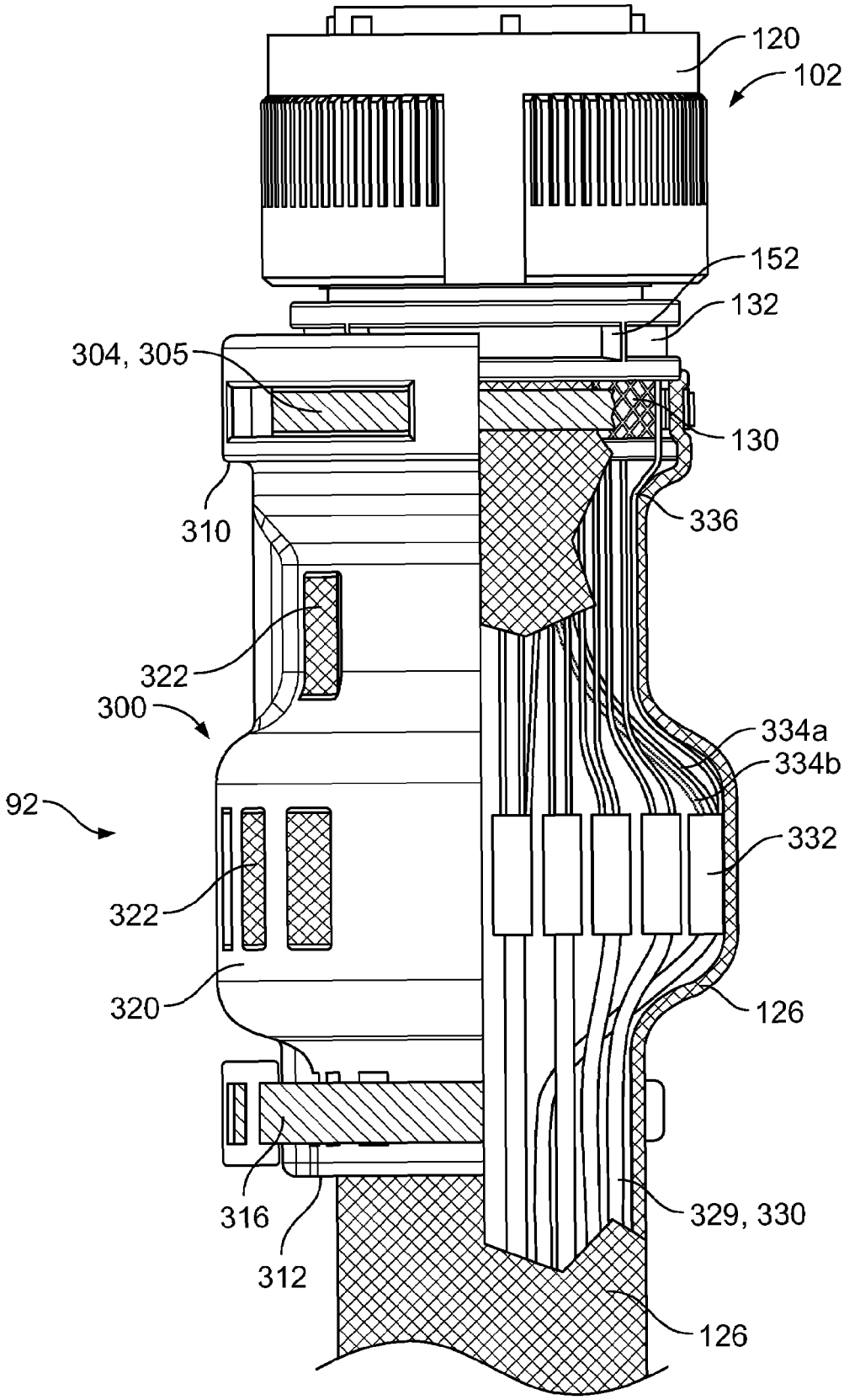
FIG. 10 is a partial cross-section side view of an embodiment of a backshell assembly.

In accordance with one aspect of the embodiments described herein, there is provided a backshell device with improved signal integrity that is less complicated, more light weight, and easier to build and use. FIG. 10 illustrates a backshell assembly 92 with increased protection, wherein the terminations are protected within the backshell device 300, and wherein there is provided an optional increased-diameter section configured to accommodate a plurality of non-staggered or aligned solder sleeves 332. FIG. 10 is a perspective view of an improved backshell assembly 92 having a backshell device 300 coupled to a connector 102 via a securing member 304.

Backshell device 300 generally has a mounting section 310 and an extension section 312. The backshell device 300 can be generally cylindrical (e.g., semi-cylindrical), covering all or a portion of the overbraid 126 and the wiring harness 329, etc. contained therein. The backshell 300 does not necessarily have to be uniform with respect to how much of the overbraid 126 and its contents are covered. In the embodiment shown in FIG. 10, mounting section 310 and removable extension section 312 are semi-cylindrical. Sections 310 and 312 preferably comprise a lightweight material, such as a composite material, a metallic material, a metallic composite material, or various combinations thereof. The backshell device 300 can comprise one or more optional fenestrations 322.

Mounting section 310 of backshell device 300 couples to an adaptor 129, which in turn couples with connector 102. The adaptor 129 (illustrated in FIG. 12) comprises a recessed groove 132 and one or more anti-rotation features 152 that comprises protruding teeth spaced apart along the arced surfaced of the recessed groove 132 to secure position and inhibit rotation of the backshell device 300 with respect to the adaptor 129 and the connector 102. Securing member 304 is positioned around mounting section 310 and secures mounting section 310 of backshell device 300 to the adaptor 129.

The mounting section 310 typically comprises a slot or groove 305 for receiving securing member 304. In one embodiment, securing member 304 comprises a band or band clamping device formed of various types of high strength materials, such as composite materials and various types of metal, such as, for example, stainless steel, aluminum, magnesium, titanium, or combinations thereof. Securing member 304 clamps overbraid or shielding sock 126 and/or wiring harness directly to mounting section 310 of backshell device 300 and recessed groove 130 of the adaptor 129.

The adaptor 129 comprises a first recessed groove 130 that receives securing member 304 of backshell device 300. In one embodiment, first recessed groove 130 includes a knurled surface. In general, the knurled surface of first recessed groove 130 may comprise various geometrical patterns and shapes, including diamond, rectangular, triangular, etc., without departing from the scope of the present invention. The adaptor 129 comprises a second recessed groove 132 that receives a lip feature or the like of mounting section 310 of backshell device 300 to secure backshell device 300 to adaptor 129, and to inhibit slippage of backshell device 300 from adaptor 129.

The adaptor 129 is typically coupled to connector 102 via a threaded interconnection or the like. Epoxy (e.g., conductive epoxy) can be applied to a threaded rear plug shell of the connector 102 prior to placing the adaptor 129 against and/or over at least a portion of the plug shell of the connector 102. The threaded interconnection between connector 102 and a threaded inner surface of the adaptor 129 secures the adaptor 129 and backshell device 300 to connector 102.

It is noted that the extension section 312 can be a removable extension section that can be separated from mounting section 310 of backshell device 300. In one embodiment wherein the extension section 310 is removable, a portion of backshell device 300 can be removed when extension section 312 is separated from the mounting section 310. For example, approximately 65% of backshell device 300 can be removed when extension section 312 is separated from mounting section 310. In general, the weight of backshell device 300 can be reduced when extension section 312 is separated from mounting section 310. Without departing from the scope of the present invention, it should be appreciated by those skilled in the art that the backshell devices can be manufactured with removable extension section 312 of various lengths to accommodate various types and sizes of wiring harnesses with or without the inclusion of overbraid 126.

In one embodiment, wiring harness 329 can be secured to extension section 312 via at least one tie wrap 316, such as a plastic tie wrap including high temperature tie wraps, to provide strain relief to wiring harness 329. In addition, wiring harness 329 may comprise an overbraid or shielding sock 126 that shields wiring harness 329 from external interference, such as high frequency communication signals, white noise, etc. Wiring harness 329 generally comprises one or more wires 330, such as a group of wires. It should be appreciated by those skilled in the art that overbraid 126 is optional, and that backshell device 300 can be coupled to connector 102 (e.g., via adaptor 129) with or without overbraid 126. It will be noted that variations of adaptor 129 can be used to couple the backshell device 300 to the connector 102. It is also noted that the adaptor 129 is optional and that in another embodiment (not illustrated) the backshell device 300 connects directly with the connector 102.

In contrast to traditional backshell designs, the backshell 300 shown in FIG. 10 comprises an optional increased-diameter section 320 to accommodate and house a plurality of solder sleeves 332. The plurality of solder sleeves 332 housed within increased-diameter section 320 can comprises all or a subset of the sleeves 332 for the wires 330. In the embodiment of FIG. 10, each of the sleeves 332 are lined up rather than being staggered. A non-staggered arrangement of the sleeves 332 makes it possible to minimize the lengths of the wires above the sleeve, thereby improving signal integrity.

Figure 12:
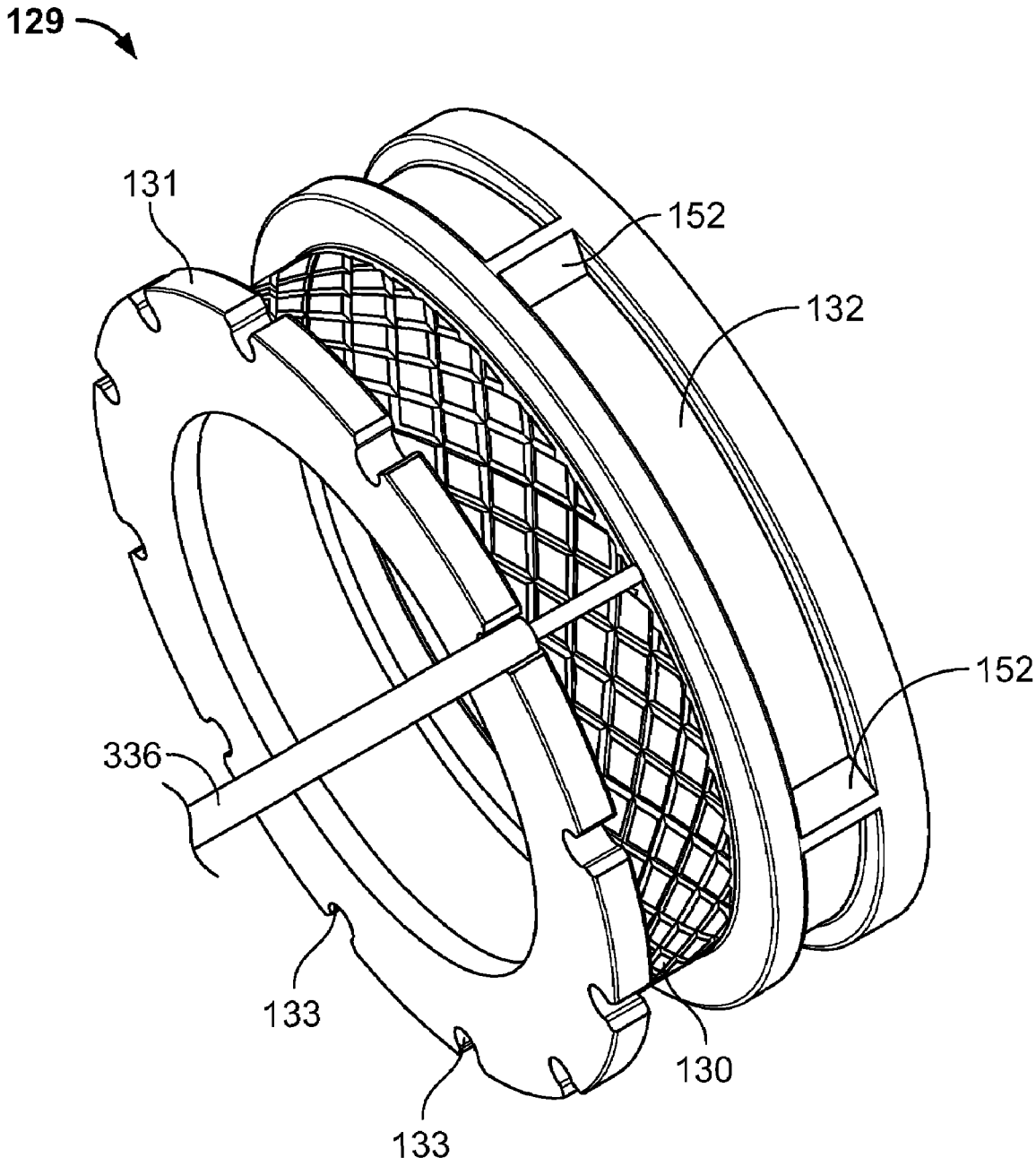
FIG. 12 is a side elevational, schematic view of an embodiment of an adaptor configured to connect with a connector and a backshell device.

The pigtails 336 of the wires 330 are secured to the nearby adaptor 129, such that no split ring or the like is needed to secure the pigtails 336. As shown in FIG. 12, the pigtails 336 can be inserted through grooves 133 on a proximal wall 131 of the adaptor 129 and secured to the adaptor 129 via any suitable attachment method known in the art.

In one embodiment, the wires 334 are all at the minimum length that allows for repair, thus improving signal integrity. In another embodiment, the wires 334 are all at the minimum length that allows the solder sleeves 332 to be in a non-staggered or aligned arrangement. The combination of the plated backshell 300 and braidsock 126 provide enhanced signal integrity. The simple one-piece backshell device 300 with a short (e.g., about 2.5 inch) braidsock 126 result in decreased weight. The shield termination within the protection of the backshell device 300, along with pigtails 136 that are directly terminated to plug shell, all help to provide increased reliability. The backshell and/or adaptor can be conductive plated to provide a direct shielding path, thereby providing superior EME/lightning strike shielding capabilities.

Figure 11:
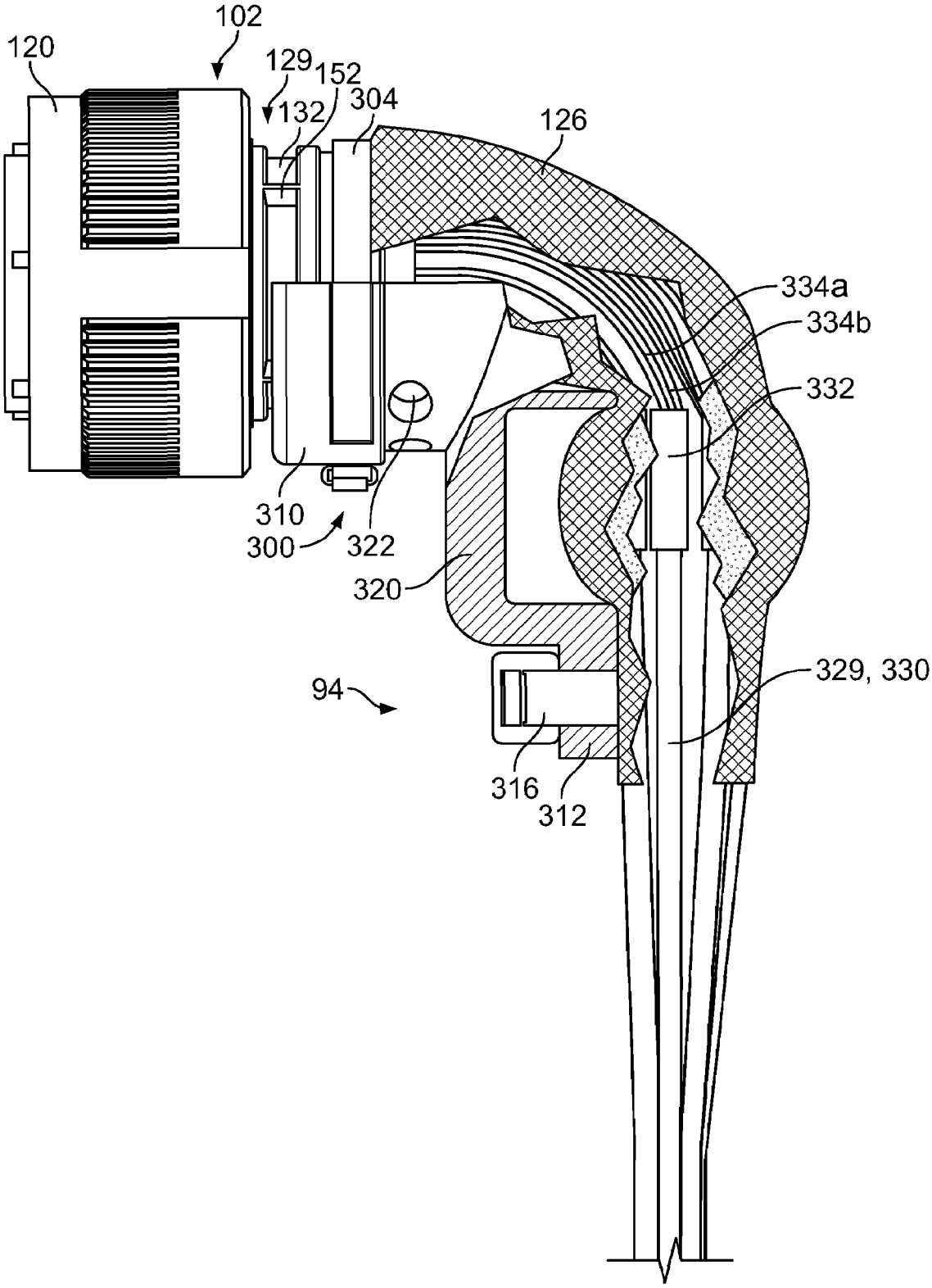
FIG. 11 is a partial cross-section side view of another embodiment of a backshell assembly.
Figure 13A:
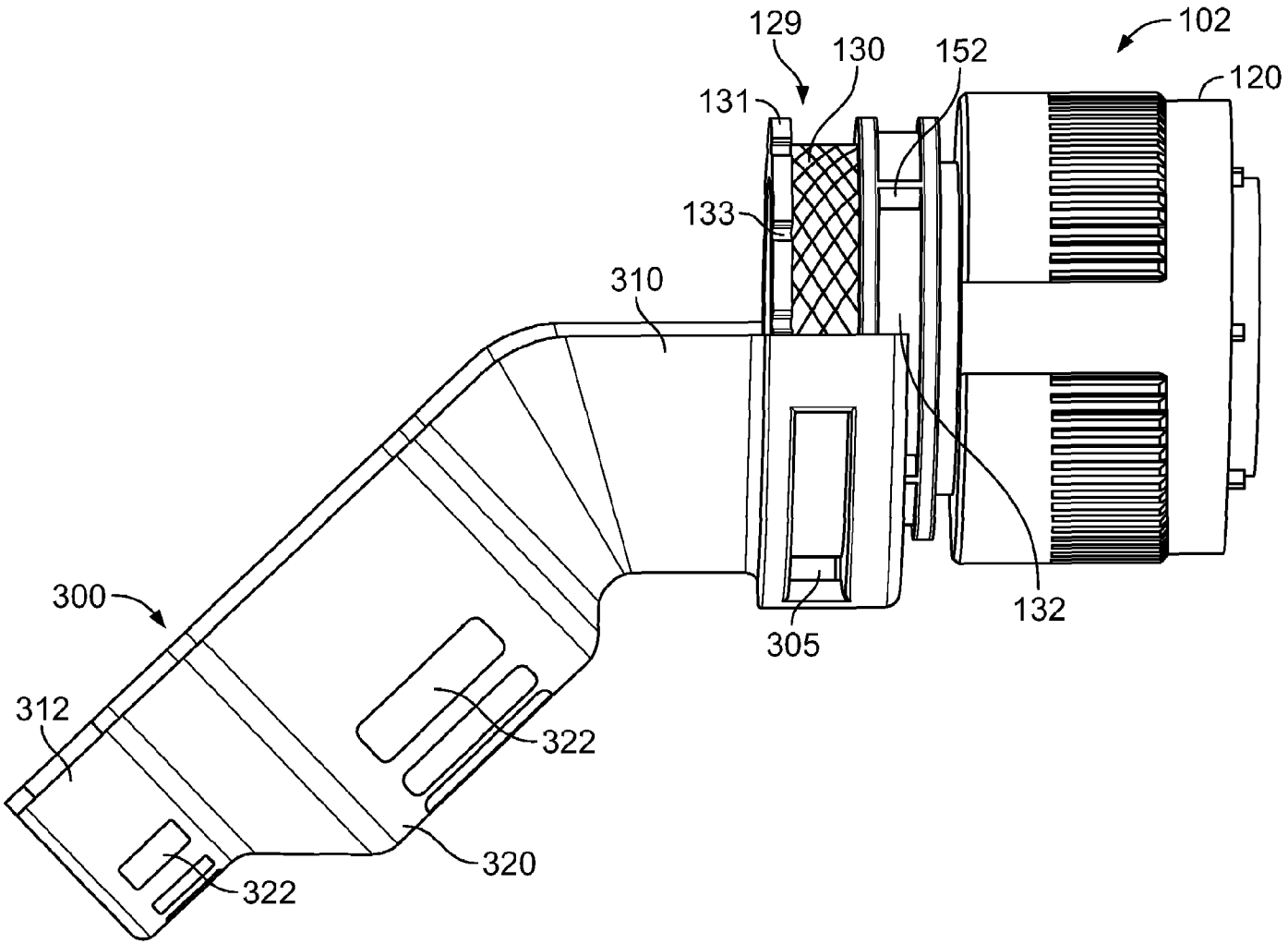
FIGS. 13A-13B are perspective views of an embodiment of a backshell device with adaptor and connector.
Figure 13B:
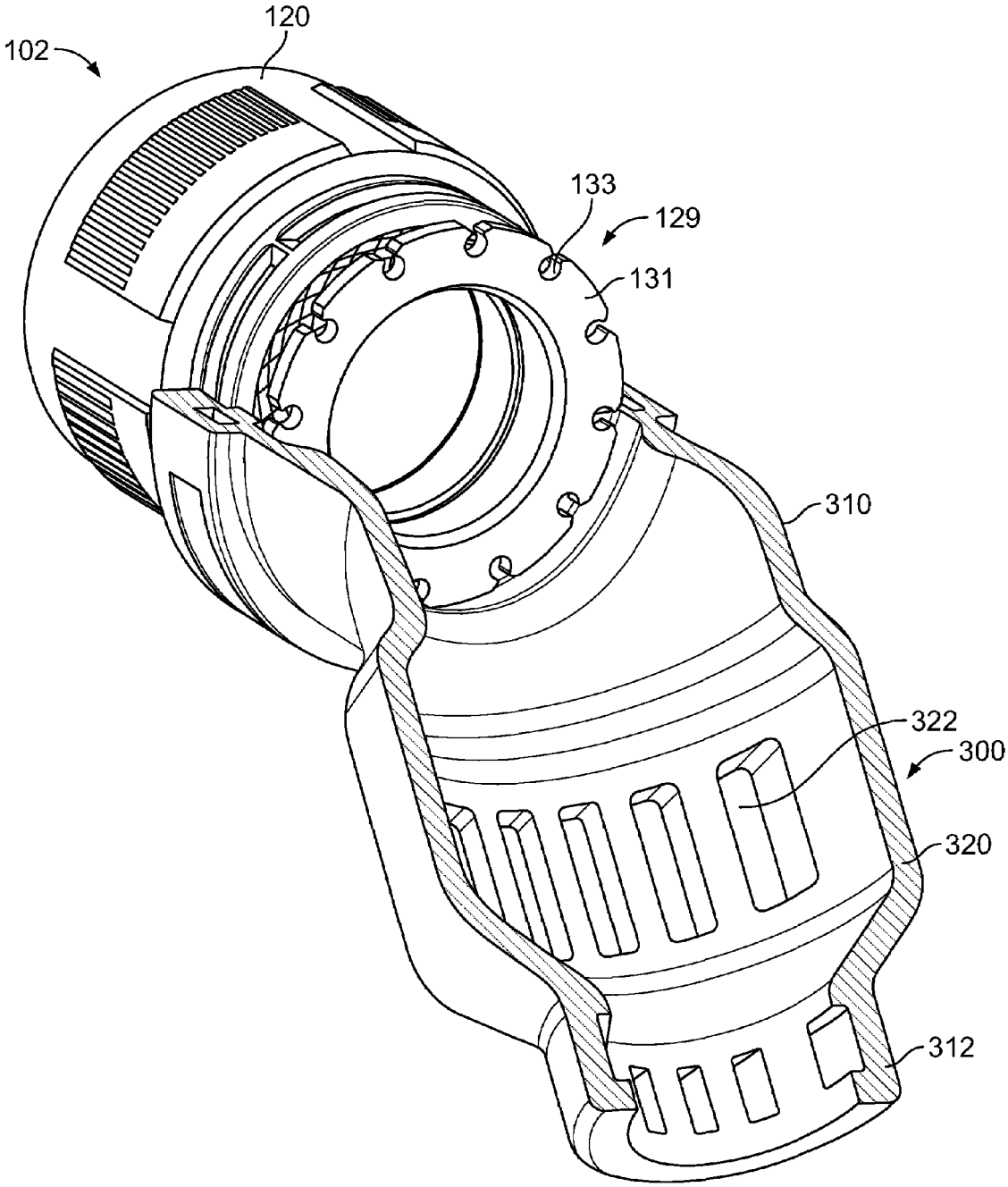
Figure 14:
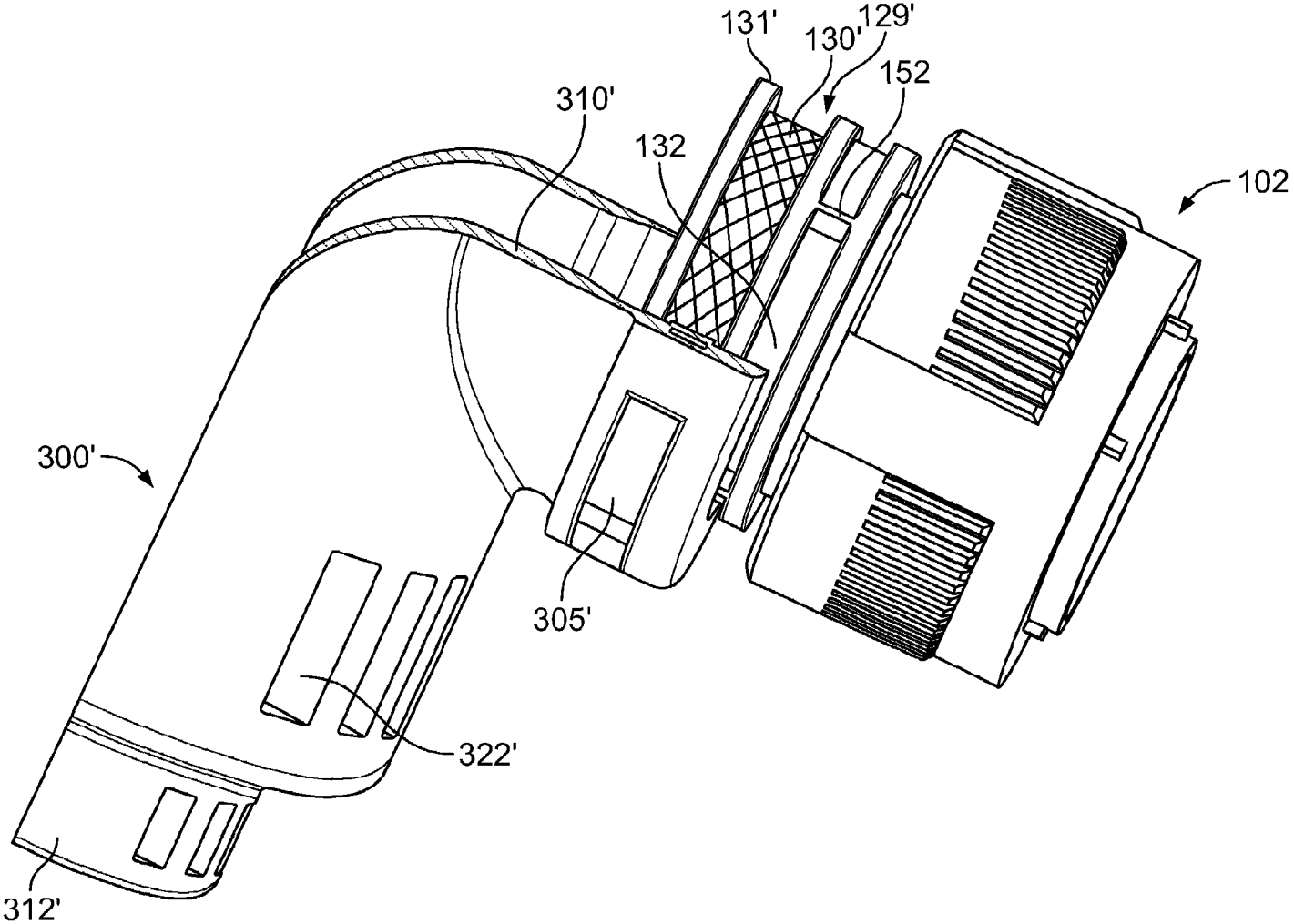
FIG. 14 is a perspective view of an another embodiment of a backshell device with adaptor and connector.

With reference to FIG. 11, there is provided a backshell assembly 94 wherein the mounting section 310 and the extension section 312 of the backshell device 300 are angled at about 90° with respect to each other. With reference to FIGS. 13A and 13B, there are provided multiple views of yet another embodiment of the backshell design wherein the mounting section 310 and the extension section 312 of the backshell device 300 are angled about 45° with respect to each other. FIG. 14 illustrates still another embodiment of a backshell design with a modified different backshell device 300' and slightly different adaptor 129'. The backshell device 300' comprises an extended increased-diameter section 320', while the mounting section 310' and the extension section 312' are angled about 90° with respect to each other. The adaptor 129' does not have grooves on the proximal wall 131'. As explained previously, the relative positioning of the mounting section and the extension section can be varied as appropriate for given applications. In addition, the general configuration, dimensions, geometry, and details (e.g., the number and positions of fenestrations or holes) of the backshell device and components thereof can varied for given applications.

Having thus described the embodiments of an improved backshell device and assembly, it should be apparent to those skilled in the art that certain advantages have been achieved. It should also be appreciated that various modifications, adaptations, and alternative embodiments thereof may be made within the scope and spirit of the present invention. The invention is solely defined by the following claims.

What is claimed is:

1. A backshell device for a connector, comprising:

an adaptor configured to couple to the connector, the adaptor comprising a first anti-rotation feature on an outer surface of the adaptor;

a mounting section coupled to the adaptor and configured to at least partially cover a wiring harness and receive a securing member that wraps around the mounting section, the mounting section comprising a second anti-rotation feature on an inner surface of the mounting section, the first and second anti-rotation features being complementary to each other;

an extension section extending from the mounting section and configured to at least partially cover the wiring harness, the extension section comprising an increased-diameter section configured to accommodate a plurality of aligned solder sleeves of the wiring harness, the increased-diameter section allowing each of signal wires extending from the solder sleeves to have a uniform predetermined length; and a securing member positioned around the mounting section;

wherein the adaptor is further configured to surround the signal wires and receive pigtails extending from the solder sleeves.

2. The backshell device of claim 1, wherein at least one of the mounting section and the extension section is semi-cylindrical.

3. The backshell device of claim 1, wherein the extension section comprises a removable extension section.

4. The backshell device of claim 1, wherein at least one of the mounting section and the extension section comprises a lightweight composite material.

5. The backshell device of claim 1, wherein the mounting section and the extension section each at least partially cover an overbraid that shields the wiring harness.

6. The backshell device of claim 1, wherein a portion of the extension section extends from the mounting section at an angle between about 0° and about 90°.

7. The backshell device of claim 1, wherein a portion of the extension section extends from the mounting section at about an 90° angle.

8. A backshell device for a connector, comprising:

a mounting section coupled to a portion of the connector and configured to at least partially cover a wiring harness and receive a securing member that wraps around the mounting section, the mounting section comprising a first anti-rotation feature on an inner surface of the mounting section, the anti-rotation feature being complementary to a second anti-rotation feature on the outer surface of the connector;

an extension section extending from the mounting section and configured to at least partially cover the wiring harness, the extension section comprising an increased-diameter section configured to accommodate a plurality of aligned solder sleeves of the wiring harness, the increased-diameter section allowing each of signal wires extending from the solder sleeves to have a uniform predetermined length; and a securing member positioned around the mounting section.

9. The backshell device of claim 8, wherein at least one of the mounting section and the extension section is semi-cylindrical.

10. The backshell device of claim 8, wherein the extension section comprises a removable extension section.

11. The backshell device of claim 8, wherein at least one of the mounting section and the extension section comprises a lightweight composite material.

12. The backshell device of claim 8, wherein the mounting section and the extension section each at partially cover an overbraid that shields the wiring harness.

13. The backshell device of claim 8, wherein a portion of the extension section extends from the mounting section at an angle between about 0° and about 90°.

14. The backshell device of claim 8, wherein a portion of the extension section extends from the mounting section at about an 90° angle.

15. A backshell assembly comprising:

a connector;

an adaptor coupled to the connector and configured to couple to the connector, the adaptor comprising a first anti-rotation feature on an outer surface of the adaptor;

a backshell device comprising:

a mounting section coupled to the adaptor, the mounting section configured to at least partially cover a wiring harness and receive a securing member that wraps around the mounting section, the mounting section comprising a second anti-rotation feature on an inner surface of the mounting section, the first and second anti-rotation features being complementary to each other; and;

an extension section extending from the mounting section and comprising an increased-diameter section configured to accommodate a plurality of aligned solder sleeves of a wiring harness, the increased-diameter section allowing each of signal wires extending from the solder sleeves to have a uniform predetermined length;

a braidsock configured to cover the wiring harness; and a securing member positioned around the mounting section and the braidsock;

wherein the adaptor is further configured to surround the signal wires and receive pigtails extending from the solder sleeves.

16. The assembly as recited in claim 15, wherein at least one of the mounting section and the extension section is semi-cylindrical.

17. The assembly as recited in claim 15, wherein at least one of the mounting section and the extension section comprises a lightweight composite material.

18. The assembly as recited in claim 15, wherein the uniform predetermined length comprises approximately 1.5 inches.

19. The assembly as recited in claim 15, wherein the uniform predetermined length comprises approximately 1 inch.

20. The assembly as recited in claim 15, wherein the mounting section and the extension section each at least partially cover an overbraid that shields the wiring harness.

* * * * *